United States Patent [19]

Doyel

[11] 4,168,560

[45] Sep. 25, 1979

[54] BATTERY-DRIVEN CLEANING DEVICE

[76] Inventor: John S. Doyel, 404 W. 20th St., New York, N.Y. 10011

[21] Appl. No.: 950,672

[22] Filed: Oct. 12, 1978

[51] Int. Cl.[2] ..... A46B 13/04

[52] U.S. Cl. ..... 15/29

[58] Field of Search ..... 15/22, 23, 24, 28, 29, 15/97 R

[56] References Cited

U.S. PATENT DOCUMENTS

| | | | |
|---|---|---|---|
| 1,952,910 | 3/1934 | Decker | 15/29 X |
| 3,396,417 | 8/1968 | Starr | 15/29 |
| 3,404,420 | 10/1968 | Lachat et al. | 15/29 |
| 3,443,272 | 5/1969 | Trelc et al. | 15/29 |
| 3,943,591 | 3/1976 | Lanusse | 15/29 |

*Primary Examiner*—Edward L. Roberts

*Attorney, Agent, or Firm*—Cooper, Dunham, Clark, Griffin & Moran

[57] ABSTRACT

A battery-driven cleaning device has a pair of rotary attachments for brushing, scrubbing or buffing and is made primarily of inexpensive molded plastic parts. The device can work with or without a detachable reservoir unit which dispenses a cleaning agent.

5 Claims, 10 Drawing Figures

BATTERY-DRIVEN CLEANING DEVICE

BACKGROUND AND SUMMARY OF THE INVENTION

The invention is in the field of battery-driven, hand-held cleaning devices for brushing, scrubbing or buffing by the use of rotary cleaning attachments and has as its object to provide a device of this type which is particularly easy to manufacture, and is therefore inexpensive, but which is effective in use.

There is a wide variety of power-driven cleaning devices using rotary cleaning attachments and perhaps capable of dispensing a cleaning or polishing agent. Some examples are illustrated in the following U.S. Pat. Nos. 1,300,128; 1,374,772; 1,550,187; 1,578,013; 1,736,446; 1,952,910; 2,635,268; 2,730,738; 3,065,477; 3,638,264 and 3,932,908. The cleaning device embodying this invention differs from the prior art known to applicant by its particularly synergistic combination of parts which combination makes it both efficient to use and inexpensive to manufacture.

A particular embodyment of the invention is a battery-driven cleaning device made primarily of inexpensive molded plastic parts. The device includes a housing made of a pair of elongated mating half-shells which form a head at the front end of the device and a battery compartment and a handle at the back end of the device. A disc-shaped power unit is gripped within the jaws of the half-shells forming the head of the housing. The power unit includes an electric motor, a reduction gear system driven by the motor and a pair of downwardly facing power-coupling receptacles which are spaced from each other and are rotatably driven by the reduction gear system. The receptacles receive interchangeable cleaning attachments such as rotary brushes, sponges and buffers. A manually operable electrical switch of a particularly efficient construction selectively connects the motor to batteries contained in the battery compartment of the housing. A detachable reservoir unit may be affixed to the housing above the power drive unit so as to selectively dispense a cleaning agent through a spout which extends downwardly through a suitable opening in the power drive unit at a location adjacent the rotary cleaning attachments. The reservoir unit includes a manually operable value unit for pumping out cleaning agent by a press button located near the housing handle. The cleaning device can operate with or without the reservoir unit. There is a pivoted, adjustable rest stand at the underside of the device which can be folded to be out of the way while the device is used for cleaning but can be unfolded to permit resting the device on a working surface without crushing the brushes or other cleaning attachments.

DETAILED DESCRIPTION

Figure 1:
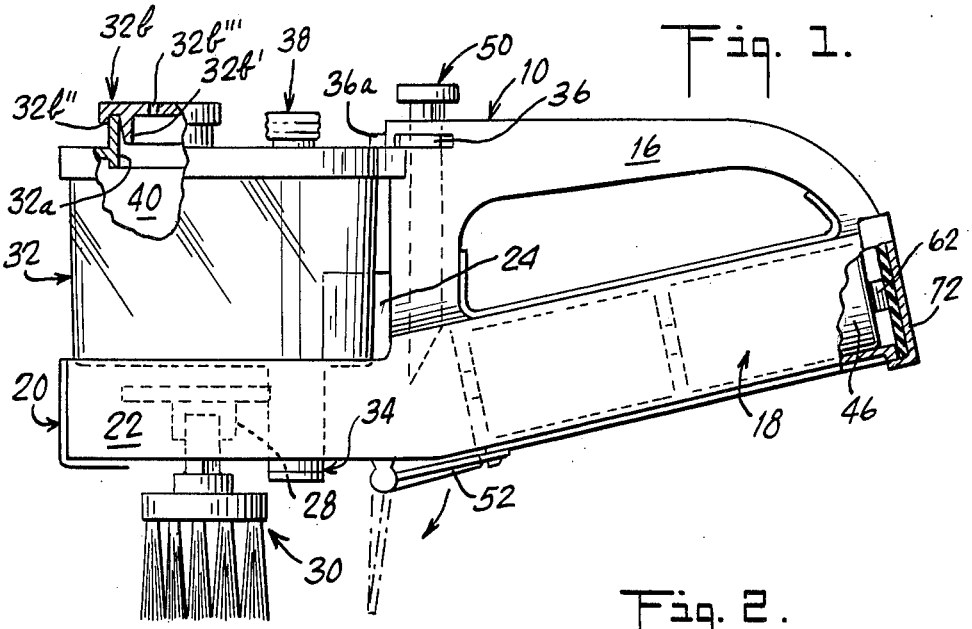
FIG. 1 is a side view of the cleaning device which is partly elevational and partly sectional.
Figure 2:
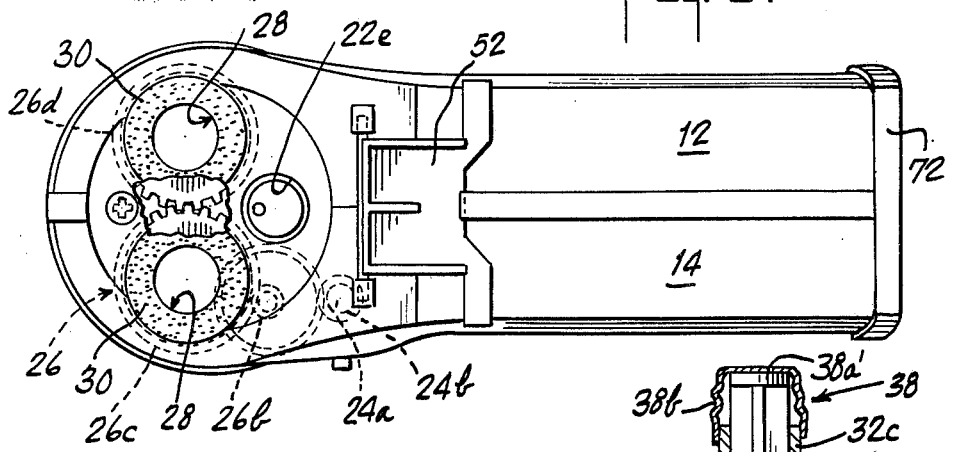
FIG. 2 is a bottom view of the device which is partly plan and partly sectional.
Figure 3:
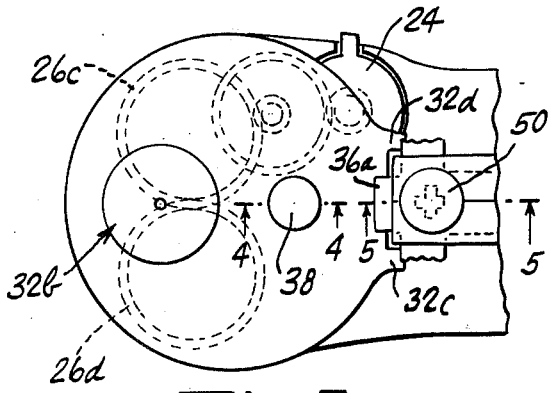
FIG. 3 is a top plan view of a front portion of the device.
Figure 5:
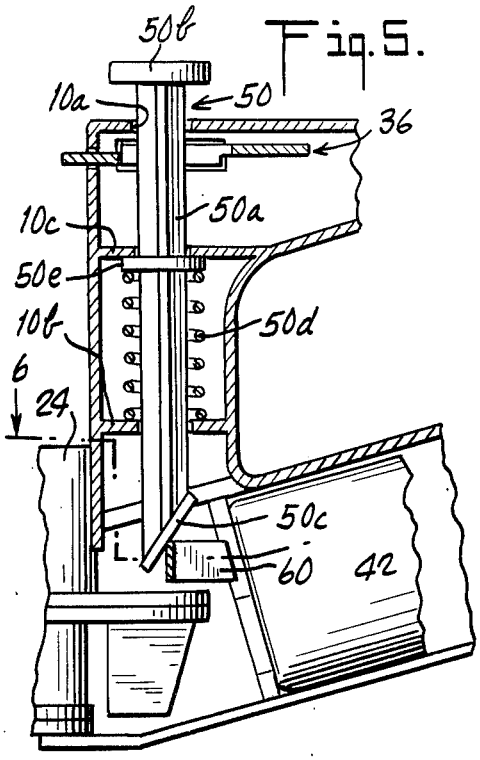
FIG. 5 is a sectional view along line 5—5 of FIG. 3.
Figure 7:
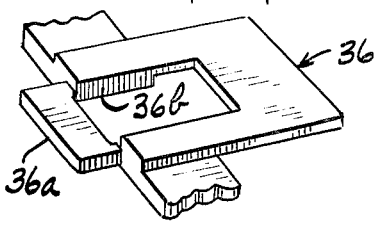
FIG. 7 is a partial isometric view of a slide used for locking in place a reservoir unit which forms a part of the device.
Figure 8A:
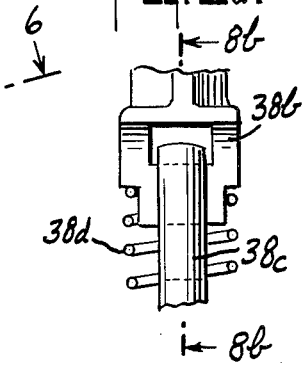
FIG. 8*a* is a sectional view along line 8—8 of FIG. 4.
Figure 8B:
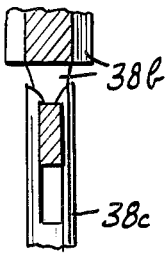
FIG. 8*b* is a sectional view taken along line 8*b*—8*b* of FIG. 8*a*.

The cleaning device includes a housing generally indicated at 10 formed of two half-shells 12 and 14 joined along a plane which is parallel to the paper in the view of FIG. 1 and runs through the center of the device in the view of FIG. 2. The half-shells 12 and 14 may be joined by butt seams and held by suitable screws or they may be joined by sonic welding. The back portion of the housing 10 is formed into the shape of a handle 16 and a hollow battery compartment 18. The front of the housing 10 is in the form of a head generally indicated at 20 formed by respective jaws of the half-shells 12 and 14. The jaws which form the head 20 encircle and support a power unit generally indicated at 22 which includes an electric motor 24, a reduction gear system generally indicated at 26 which is driven by the motor 24 and a pair of power-coupling receptacles, one of which is generally indicated at 28, which are spaced from each other and face downwardly from the power unit 22. The receptacles 28 are rotatably driven by the reduction gear system 26 and each can receive and rotate an interchangeable cleaning attachment such as the rotary brush 30 shown in FIG. 1. Other cleaning attachments such as rotary sponges and rotary buffers may be used instead of the rotary brushes 30. The cleaning attachments have suitable shafts fitting frictionally within the respective receptacle 28 so as to be rotated thereby. An attachment such as the rotary brush 30 can be pulled off from the receptacle by hand and replaced by another cleaning attachment. A detachable reservoir unit generally indicated at 32 rests on the power unit 22 and has a spout 34 extending downwardly through a suitable opening in the power unit 22. A locking slide 36 slides in the housing 10 between the locked position shown in FIG. 1, in which it secures the reservoir unit 32 in place and an unlocked position, not shown, to the right of the shown position in FIG. 1, to permit the reservoir unit 32 to be lifted from the device and removed from it. The reservoir unit 32 includes a valve unit generally shown at 38 in FIG. 2 for selectively discharging cleaning agent from a reservoir 40 which is also a part of the reservoir unit 32. The motor 24 is energized by batteries, such as four D cell batteries 42, 44, 46 and 48 connected in series with each other and connectable to the motor through an electrical switch generally indicated at 50 in FIG. 5. An adjustable rest stand generally indicated at 52 is pivotably secured to the underside of the device to move between a folded position shown in solid lines in FIG. 1 and an extended position shown in broken lines.

In operation, suitable cleaning attachments such as the rotary brushes 30 are pushed into the power-couple receptacles 28, the rest stand 52 is moved up to its folded position, where it is kept by the friction at its pivot, and the electrical switch 50 is manually depressed to electrically connect the motor 24 to the batteries in the battery compartment 18. The device can then be used as a battery-powered brush, if the cleaning attachments are the brushes 30, or can be used to scrub, with cleaning attachments which are sponges (not shown) or to buff, with cleaning attachments which are buffers (not shown). With the reservoir unit 32 in place suitable cleaning agent may be applied while the device is in use by pressing down manually on the valve unit 38 so as to dispense cleaning agent through the spout 34. It is noted that the term "cleaning agent" as used here includes such agents as liquid soap or scouring agent and liquid polish. Similarly, the term "clean" as used herein includes cleaning, polishing and buffing. If desired the reservoir unit 32 may be removed from the device and the device can be used for cleaning without the reservoir unit. The rest stand 52 may be extended to its open position so that the device may be laid on a surface supported by the underside of the battery compartment and by the rest stand 52, with the weight off the cleaning attachments such as the brushes 30, so as not to crush or deform the cleaning attachments.

In greater detail, the power unit 22 is generally disc-shaped and supports the motor 24 at a peripheral end, with the motor extending upwardly from the generally disc-shaped outlines of the power unit 22. The motor shaft 24*a* has affixed to it a gear 24*b* which meshes with an idler gear 26*a*. The idler gear 26*a* has affixed to it a smaller diameter gear 26*b* which meshes with a gear 26*c* having at its center one of the power-couple receptacles 28. The gear 26*c* meshes with a similar gear 26*d* having at its center the other power-couple receptacle 28. The power unit 22 also includes an opening 22*e* through which the spout 34 of the reservoir unit 32 can pass.

Figure 4:
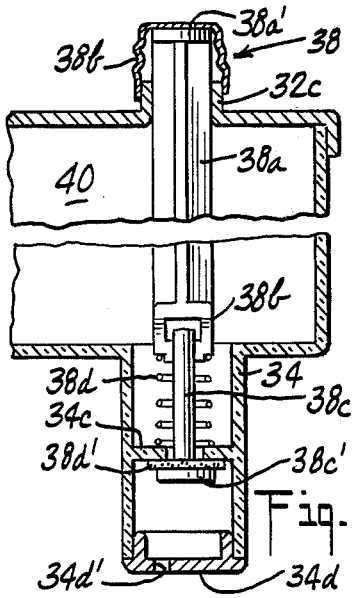
FIG. 4 is a sectional view along line 4—4 of FIG. 3.

The reservoir unit 32 includes a filler hole 32*a* formed as an upwardly extending collar receiving a filler cap 32*b* which has a tapered downwardly extending inner sleeve 32*b*′ frictionally fitting within the filler hole 32*a* and an outer sealing flange 32*b*″. The filler cap 32*b* also has a small air hole 32*b*‴. Referring to FIG. 4 for greater detail, the valve unit 38 of the reservoir unit 32 comprises a valve shaft 38*a* which extends up through a top opening in the reservoir 40 formed by an upwardly extending collar 32*c* and extends through the reservoir 40 downwardly into the spout 34. The valve shaft 38 has at its top end a press button 38*a*′ which is covered by a flexible cap 38*b*. The cap 38*b* is made by a material such as flexible vinyl and fits around the collar 32*c* in an airtight fit. The valve shaft 38 has at its bottom end a loop 38*b* to which a forked extension 38*c* is secured by a snap-fit. The extension 38*c* has a head 38*c*′ at its bottom end which is below an apertured shelf 34*c* in the spout 34. A flexible washer 38*d*′ is used as a spacer between the head 38*c*′ and the apertured wall 34*c*. A compression spring 38*e* presses against the apertured wall 34*c* and the loop 38*b* of the valve shaft 38*a* to urge the valve shaft up and to thereby close off the aperture in the wall 34*c* with the washer 38*d*. The bottom of the spout 34 is closed off with a cap 34*d* which has a small hole 34*d*′. The hole 34*d*′ is dimensioned to permit outflow of cleaning agent under some pressure but to tend to prevent outflow of cleaning agent (by surface tension forces) when there is no pressure. In operation the push-button 38*a*′ is manually pushed down through the cap 38*b*, to thereby permit flow of cleaning agent through the aperture in the wall 34*c* and around the washer 38*d*′. Depression of the cap 38*b* causes some increase of air pressure within the reservoir 40 which is sufficient to force cleaning agent through the hole 34*d*. Note that the air hole 32*b*″ in the cap 32*b* is considerably smaller than the hole 34*d* at the bottom of the spout so that the fluid outflow is mainly through the bottom hole 34*d*′.

The reservoir unit 32 is kept in place by the fit of the spout 34 within the opening 22*e* of the power unit 22, by the loose fit of two prongs 32*c* and 32*d* around the front portion of the handle 16 and by the tongue 36*a* of the locking slide 36 which fits over the top of the reservoir unit 32 in its locking position shown in FIG. 1. The reservoir unit 32 can easily be lifted and removed from the housing when the locking slide 36 is pushed to the right in FIG. 1 such that its tongue 36*a* clears the reservoir unit 32.

The electrical switch generally indicated at 50 comprises, in greater detail, a switch shaft 50*a* which extends downwardly into the housing 10 through a suitable opening 10*a* therein. The switch shaft 50*a* also passes through a suitable opening 36*b* in the locking slide 36, this opening 36*b* being of sufficient size to permit relative motion between the slide 36 and the switch shaft 50*a* in moving the locking slide from its locked to its unlocked position. The switch shaft 50*a* has a push cap 50*b* at its top end and a cam surface 50*c* at its bottom end. The switch shaft 50*a* is urged upwardly, to the position shown in solid lines in FIG. 5 by a compression spring 50*d* contained between a collar 50*e* on the switch shaft 50*a* and a land 10*b* formed integrally with the housing 10. The switch shaft 50*a* is kept from going further up by a land 10*c* which is also part of the housing 10 and constrains the collar 50*e* to the space between the lands 10*b* and 10*c*. The cam 50*c* at the bottom of the switch shaft 50*a* faces a leaf spring front contact 60 which has an end affixed to a stud 22*f* extending upwardly from the power unit 22 and a free end which has an L-shaped extension pointing to the battery 42 but being resiliently biased out of electrical contact with it. When the switch shaft 50*a* is manually pushed down the cam 50*c* bears against the free end of the leaf spring front contact 60 and pushes its L-shaped extension into electrical contact with the battery 42. The batteries 42 and 44 are end-to-end, in series contact with each other and the batteries 44 and 46 are side-by-side in series electrical contact provided by a back contact 62. The batteries 46 and 48 are end-to-end in series electrical contact and the battery 48 makes electrical contact with a permanent front contact 64 which is also affixed to the power unit 22. The front contacts 60 and 64 are connected by respective wires 66 and 68 to the motor 24. The back contact 62 is secured to a back contact plate 70 as by a rivet and the back contact plate is kept in place by a back cover plate 72 which has side channels 72*a* sliding over mating lips 10*d* of the housing 10.

Figure 6:
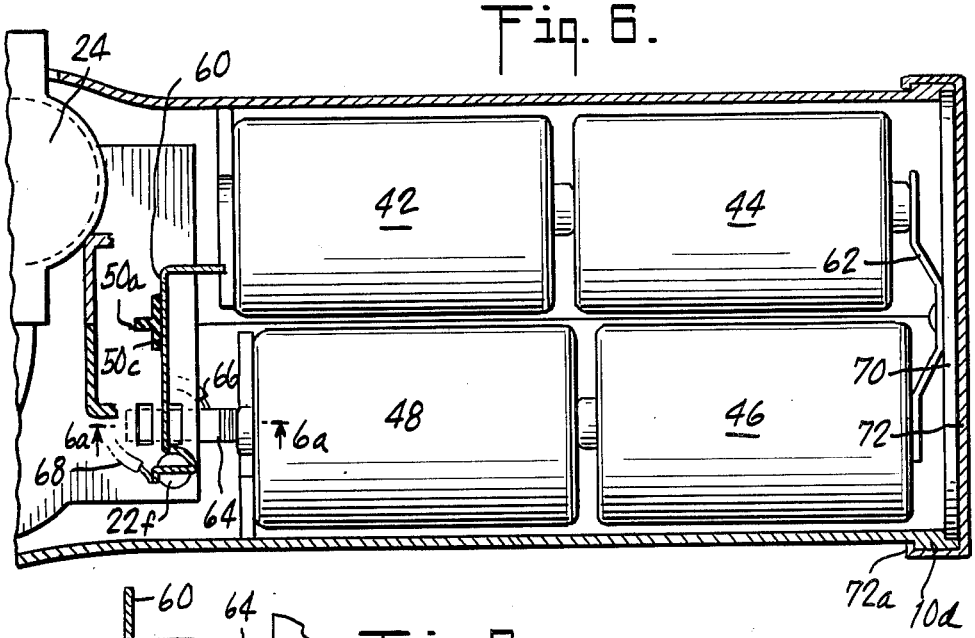
FIG. 6 is a sectional view along line 6—6 of FIG. 5.
Figure 6A:
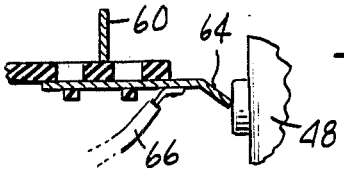
FIG. 6*a* is a partial sectional view along line 6*a*—6*a* of FIG. 6.

The entire device is made of inexpensive molded plastic components except for the motor 24, the electrical contacts 60, 62 and 64, the wires 66 and 68 and the springs 38*d* and 50*d* and of course the batteries 42, 44, 46 and 48. In addition, if it is chosen to secure the two half-shells 12 and 14 of the housing 10 to each other by fasteners rather than by sonic welding, three metal screws may be used. Still in addition, one metal screw may be used to hold together the disc-shaped power unit 22. The rest of the device, however, including the reduction gear system, is made entirely of molded plastic components. The components of the device are easily assembled, by hand or with minimal use of tools. For example, the motor 24 is friction-fitted within a molded receptacle therefor in the power unit 22 and the molded gears of the reduction gear system 26 fit within corresponding plastic bearings molded in two halves of the disc-shaped power unit 22. These two halves may be secured to each other by sonic welding or similar means or by a single screw. The valve unit may be assembled entirely by hand, by pushing the forked extension 38*c* up through the apertured wall 34*c*, dropping the compression spring 34 onto it from above and then forcing the valve shaft 38*a* down through the top opening of the reservoir 40 and forcing its loop 38*b* into a snap-fit into the forked extension 38*c*. Similarly, the leaf spring contact 60 may be secured to the stud 22*f* by hand, by simply forcing down its suitably shaped end into a slot of the stud 22*b*, and the permanent front contact 64 may be pushed to the right in FIG. 6 into a suitably molded receptacle integrally molded with the power unit 22.

The cleaning device is particularly compact and effective, at least in part because the reduction gear system 26 is compactly contained within the power unit 22 which has a small height (as visible in FIG. 1) relative to the remainder of the device.

It should be noted that orientational terms such as up, down, etc., are used merely for convenience to refer to the view of FIG. 1 and similarly oriented views and that the device in fact can be used in different orientations.

I claim:

1. A battery-driven cleaning device comprising:

a housing having a front portion which includes a head and a back portion which includes a battery compartment and a handle;

a power unit affixed to the housing head and including a electric motor, a reduction gear system driven by the motor and a pair of downwardly facing power-coupling receptacles spaced from each other which are rotatably driven by the reduction gear system and are adapted to receive rotary cleaning attachments such as brushes, sponges and buffers and to transmit rotational motion thereto;

a switch manually operable to electrically connect the motor to batteries in the battery compartment;

a detachable reservoir unit and means for removably affixing the reservoir unit to the housing, above the housing head, said reservoir unit comprising a reservoir for a cleaning agent which has at its bottom a spout extending downwardly through the power unit and has at its top, near the end adjacent to the housing handle, a top valve opening and said reservoir unit further comprising a valve unit which has a press button adjacent the housing handle protruding up through said top valve opening and a movable stopper which extends into the spout to normally keep it from discharging cleaning agent from the reservoir but to selectively discharge said cleaning agent when the press button is manually operated;

said cleaning device being capable of rotating the power-coupling receptacles, and through them any cleaning attachments fitted thereto, independently of the reservoir unit so that the device may be used with the reservoir unit affixed to the housing but also with the reservoir unit removed from the housing; and an adjustable rest stand pivotally secured to the underside of the housing adjacent the head thereof and pivoting between an extended position in which it extends from the housing to a level below that of cleaning attachments fitted to the power-coupling receptacles and a folded position in which it is substantially above said level, whereby the cleaning device can be rested on a surface with the weight of the device being off any cleaning attachments fitted thereto.

2. A cleaning device as in claim 1 in which the switch comprises a leaf-spring contact resiliently biased to be out of electrical contact with batteries in the battery compartment but being movable against the resiliency thereof into electrical contact with batteries in the battery compartment and a switch shaft extending downwardly through at least a part of the housing and having a press button at its top end which extends above the housing handle and a cam surface at its bottom end, said switch shaft being spring biased upwardly but being movable against the force of the spring bias downwardly to cause its cam to engage the leaf-spring contact and push it into electrical contact with batteries in the battery compartment.

3. A cleaning device as in claim 1 in which the valve unit includes a valve shaft extending up through said top valve opening and down into the reservoir spout, said valve shaft having said press button at its top end and said stopper at its bottom end, and including a resilient, fluid pervious cap, fitted over said push button of the valve shaft and fitted to said reservoir in an airtight fit, said reservoir being substantially fluid impervious except for its spout, whereby when the valve push button is depressed manually through the cap the resulting air pressure in the reservoir facilitates discharging cleaning agent therefrom through said spout.

4. A cleaning device as in claim 3 including a cap closing the bottom end of the spout and having a discharge hole therein and including a filler opening in the reservoir and a filler cap having an air vent hole therein, said air vent hole being of a substantially smaller size than said hole in the cap of the spout, whereby the air vent hole permits venting but also permits building up of air pressure in the reservoir when the valve unit cap is depressed which air pressure can act to facilitate discharge of cleaning fluid through said hole in the cap at the bottom of the spout.

5. A cleaning device as in claim 1 or 2 or 3 in which said housing, power unit, reservoir unit and rest stand are made substantially only of plastic molded components.

* * * * *